US005685035A

United States Patent [19]

Urness et al.

[11] Patent Number: 5,685,035

[45] Date of Patent: Nov. 11, 1997

[54] HIGH/LOW MECHANISM FOR A BED

[75] Inventors: Randall J. Urness; John A. Sheehan, both of Stevens Point, Wis.

[73] Assignee: Joerns Healthcare, Inc., Stevens Point, Wis.

[21] Appl. No.: 659,641

[22] Filed: Jun. 6, 1996

Related U.S. Application Data

[62] Division of Ser. No. 263,543, Jun. 22, 1994, Pat. No. 5,544,375.

[51] Int. Cl.[6] ..... A61G 7/012; A61G 7/015

[52] U.S. Cl. ..... 5/611

[58] Field of Search ..... 5/611, 616, 11, 5/600

[56] References Cited

U.S. PATENT DOCUMENTS

| | | | |
|---|---|---|---|
| 2,827,641 | 3/1958 | Reichert et al. | 5/611 |
| 2,913,300 | 11/1959 | Darnell et al. | 5/616 |
| 3,012,253 | 12/1961 | Reichert | 5/611 |
| 3,059,248 | 10/1962 | Wetzler . | |
| 3,132,351 | 5/1964 | Huntress et al. | 5/611 |
| 3,246,540 | 4/1966 | Pickles et al. | 5/611 |
| 3,820,176 | 6/1974 | Feiertag | 5/611 |
| 4,025,972 | 5/1977 | Adams et al. . | |
| 4,324,010 | 4/1982 | Houlberg et al. . | |
| 4,472,845 | 9/1984 | Chivetta et al. . | |
| 4,472,846 | 9/1984 | Volk, Jr. et al. . | |
| 4,545,084 | 10/1985 | Peterson . | |
| 4,660,236 | 4/1987 | Peterson . | |
| 5,105,486 | 4/1992 | Peterson . | |
| 5,245,718 | 9/1993 | Krauska | 5/618 |
| 5,269,031 | 12/1993 | Alexander . | |

*Primary Examiner*—Alexander Grosz

*Attorney, Agent, or Firm*—Price,Heneveld,Cooper,DeWitt & Litton

[57] ABSTRACT

An adjustable bed includes a mattress frame having pivotally interconnected sections, a main or base frame supporting the matress frame and telescoping leg assemblies. A first motor drive actuator is supported on the main frame. The first actuator engages a crank arm or lever fixed to a head section of the mattress frame. A second actuator is mounted on the base frame. A second actuator engages a crank arm attached to a knee section of the mattress frame when the actuator is moving to a fully retracted position. A cable carrier is engaged by the second actuator as it moves to a fully extended position. A cable assembly interconnects the cable carrier with the telescoping leg assemblies. The second and moves the mattress frame between low and high positions.

7 Claims, 5 Drawing Sheets

HIGH/LOW MECHANISM FOR A BED

This is a divisional of application Ser. No. 08/263,543, filed on Jun. 22, 1994 now U.S. Pat. No. 5,544,375.

BACKGROUND OF THE INVENTION

The present invention relates to beds and, more particularly, to adjustable, multiple position care beds.

Adjustable beds are commonly used in the healthcare field, including the institutional and home healthcare markets. Typical adjustable beds include a mattress frame or mattress support which is divided into a plurality of sections, including a head section, a seat section and a leg or foot section. These sections are pivotally interconnected and have a continuous range of adjustment. The sections are movable from a flat, patient resting position to a seated position with the legs bent or the legs straight and the patient's back angled upwardly with respect to a seat section. The sections are pivoted by motor drives, hand-operated cranks or through the patient's weight.

Full electric beds currently available typically include three electric motors to achieve the various adjustments. One motor operates the head section for back articulation. A second motor articulates the leg and knee sections to place them in a knee break position. A third electric motor operates the high/low mechanism which raises and lowers the mattress frame. The mattress frame or surface is typically lowered for sleeping but moved to a high position when patient care is being given. Raising the surface reduces back strain while changing dressings, bandages, clothing and while performing other like operations.

Examples of multi-position, adjustable beds may be found in commonly owned U.S. Pat. No. 5,245,718 entitled ADJUSTABLE BED WITH SINGLE ACTUATOR, which issued on Sep. 21, 1993, to Krauska; commonly owned U.S. Pat. No. 5,105,486 entitled ADJUSTABLE BED, which issued on Apr. 21, 1992, to Peterson; U.S. Pat. No. 3,246,540 entitled SIX-WAY DRIVE UNIT, which issued on Apr. 19, 1966, to Pickles et al. and U.S. Pat. No. 3,132,351 entitled HOSPITAL BED, which issued on May 12, 1964, to Huntress et al.

The Krauska patent discloses a bed which includes a single electric motor drive or actuator to operate a high/low mechanism and to adjust the mattress frame sections to position the user in a seated or back raised position. The actuator functions to articulate the mattress sections only when the mattress frame is in a fully lowered position.

The Peterson patent discloses a bed which includes multiple mattress frame sections and link and positioner subassemblies. A separate high/low mechanism is provided for raising the mattress frame. The frame sections may be articulated with respect to each other when the mattress frame is in a high or in a low position.

Examples of other adjustable beds may be found in U.S. Pat. No. 3,036,314 entitled ADJUSTABLE BED, which issued on May 29, 1962, to Wetzler and U.S. Pat. No. 4,472,846 entitled COUPLING SYSTEM FOR THE MOTOR DRIVE IN AN ADJUSTABLE MOTORIZED HOSPITAL BED, which issued on Sep. 25, 1984, to Volk, Jr., et al. The Wetzler patent discloses an adjustable bed including a high/low mechanism and a single drive motor. In Volk, Jr., et al., an adjustable bed is disclosed wherein different adjustment functions including high/low, back and knee adjustments are made by a single, reversible motor which is selectively coupled to a plurality of output drive shafts by a multiple clutch arrangement.

Beds heretofore provided which achieve all desired adjustment functions with motorized actuators have tended to be costly and complex. Prior approaches which have provided a single electric drive to perform all functions have suffered from undue complexity and operational difficulties. In the typical institutional or home-care market, the customer may desire full adjustability but may not be willing to pay for an adjustable bed having three drive actuators. The customer may only be able to afford a semi-electric bed which includes a pair of electric drives for head and knee positioning and a manually cranked, high/low mechanism. Beds with an electric high/low mechanism are safer for use by the caregiver. Such beds reduce back strain which may be occasioned by bending and cranking to raise the bed. Full electric beds which include three electric actuators are heavy. Typically, such beds may be delivered and installed in a home, for example, by a single delivery person. The individual may experience set up difficulties and may suffer back strain.

A need exists for an adjustable or articulated bed of reduced complexity from that heretofore provided and which is capable of achieving the full range of adjustment and movement between high and low positions with electric drives but at significantly reduced cost and weight from that heretofore available.

SUMMARY OF THE INVENTION

In accordance with the present invention, the aforementioned needs are fulfilled. Essentially, an adjustable bed is provided including a mattress frame having pivotally interconnected sections and first and second independently operated actuators. The first actuator may articulate two sections of the mattress frame, such as a head section with respect to a seat section. The second actuator is operable to articulate other sections of the mattress so that a knee break position may be achieved, for example, and also to raise and lower the mattress frame between high and low positions. The operational advantages of a full electric, three actuator bed are provided with only a pair of actuators.

In narrower aspects of the invention, the second actuator includes an extendable and retractable member or elongated tube, a lever or crank arm connected to one of the mattress sections and a bracket which engages the crank arm only upon movement of the driven member from an extended position towards a retracted position. In addition, the bed may be provided with a high/low mechanism in the form of extendable or telescoping leg sections at the bed ends. A cable carrier is interconnected with the telescoping sections through a cable assembly. The cable carrier is shifted to pull the cables and raise the bed frame upon movement of the driven member from a retracted to a fully extended position. High/low adjustment and mattress section articulation are performed sequentially.

In accordance with the present invention, head section articulation is independent of knee positioning and high/low adjustment. Retraction of the second actuator positions the bed in the low position. The actuator then pulls on the crank arm which causes the knee section to articulate. Extending the actuator will flatten the knee section of the mattress frame. Further extension of the actuator pushes on the cable carrier which pulls on the cable assemblies thereby activating the telescoping legs inside the bed ends. The legs raise the bed and perform the high/low function.

The bed in accordance with the present invention provides full adjustment with two actuators. This reduces the cost of the bed when compared to many currently available. The bed is of reduced complexity from that heretofore available. The reduction in complexity results in manufacturing and assembly advantages and improved reliability. The overall weight of the bed is reduced from full electric, three actuator beds currently available which reduces difficulties experienced with delivery and set up in the institutional and home care markets.

DETAILED DESCRIPTION OF THE PREFERRED EMBODIMENT

Figure 1:
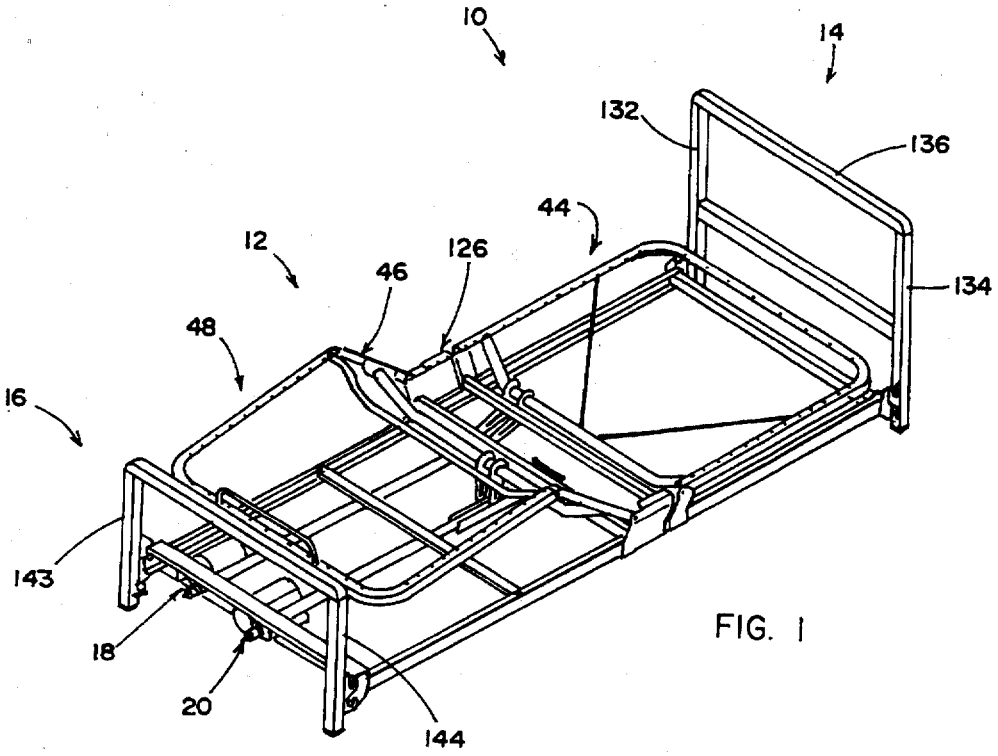
FIG. 1 is a perspective view of an adjustable bed in accordance with the present invention.
Figure 11:
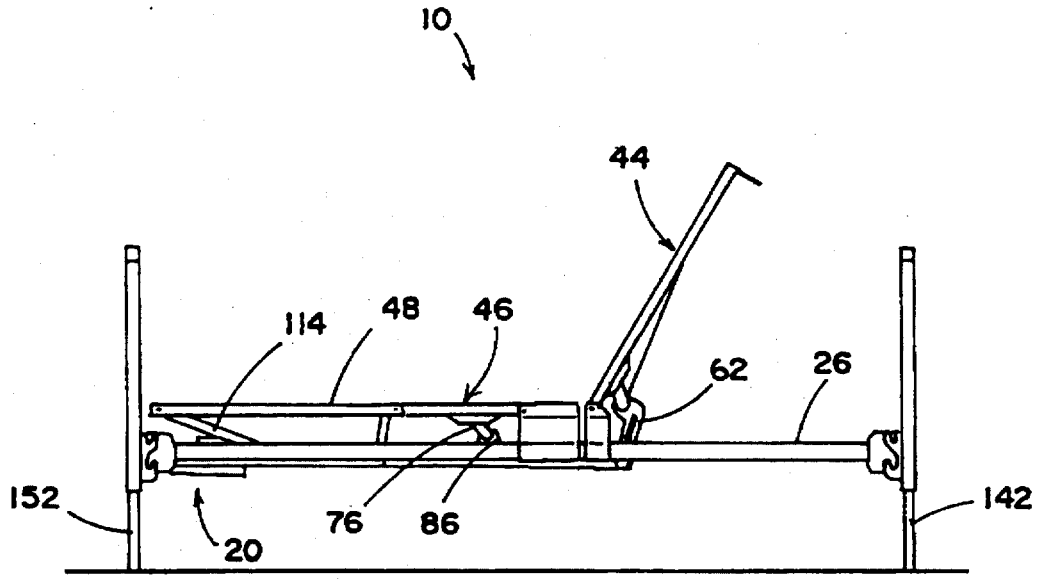
FIG. 11 is a side, elevational view of a bed in accordance with the present invention with the bed in the high position and the back section articulated.
Figure 12:
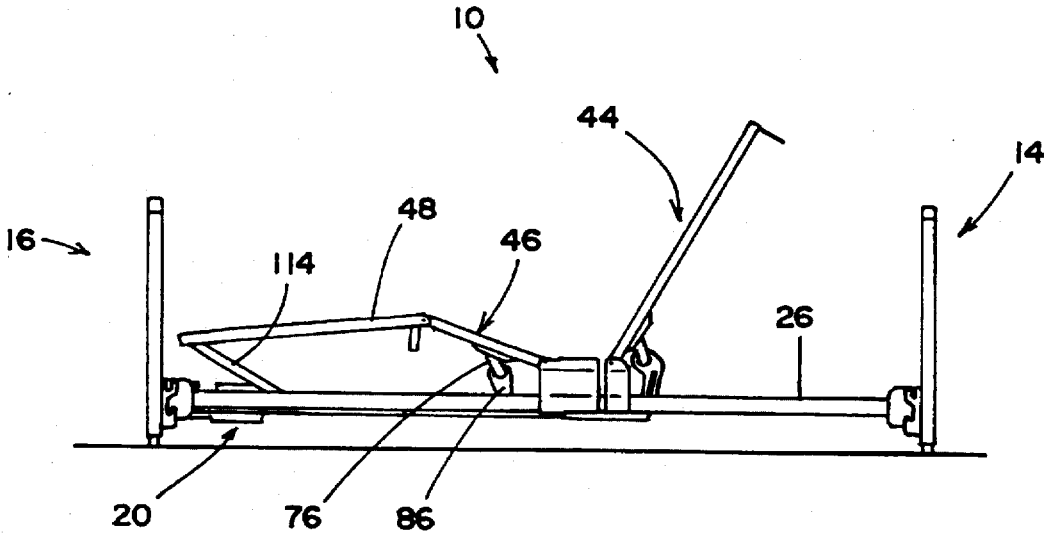
FIG. 12 is a side, elevational view of a bed in accordance with the present invention showing the bed in the lowered position with the knee and leg sections articulated and the back section articulated.

An adjustable bed in accordance with the present invention is illustrated in FIGS. 1, 11 and 12 and generally designated by the numeral 10. Bed 10 includes a mattress frame and main frame subassembly 12, leg assemblies or bed ends 14, 16 and first and second actuators 18, 20.

Figure 2:
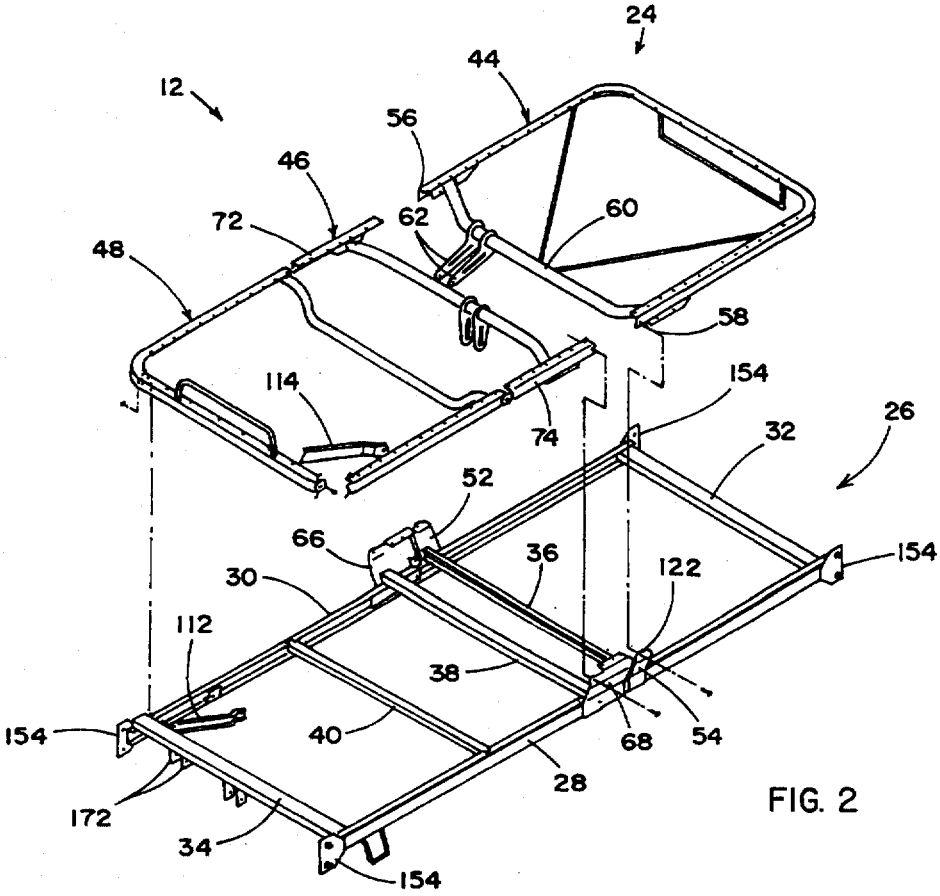
FIG. 2 is an exploded view of a mattress frame and main or base frame subassembly.
Figure 3:
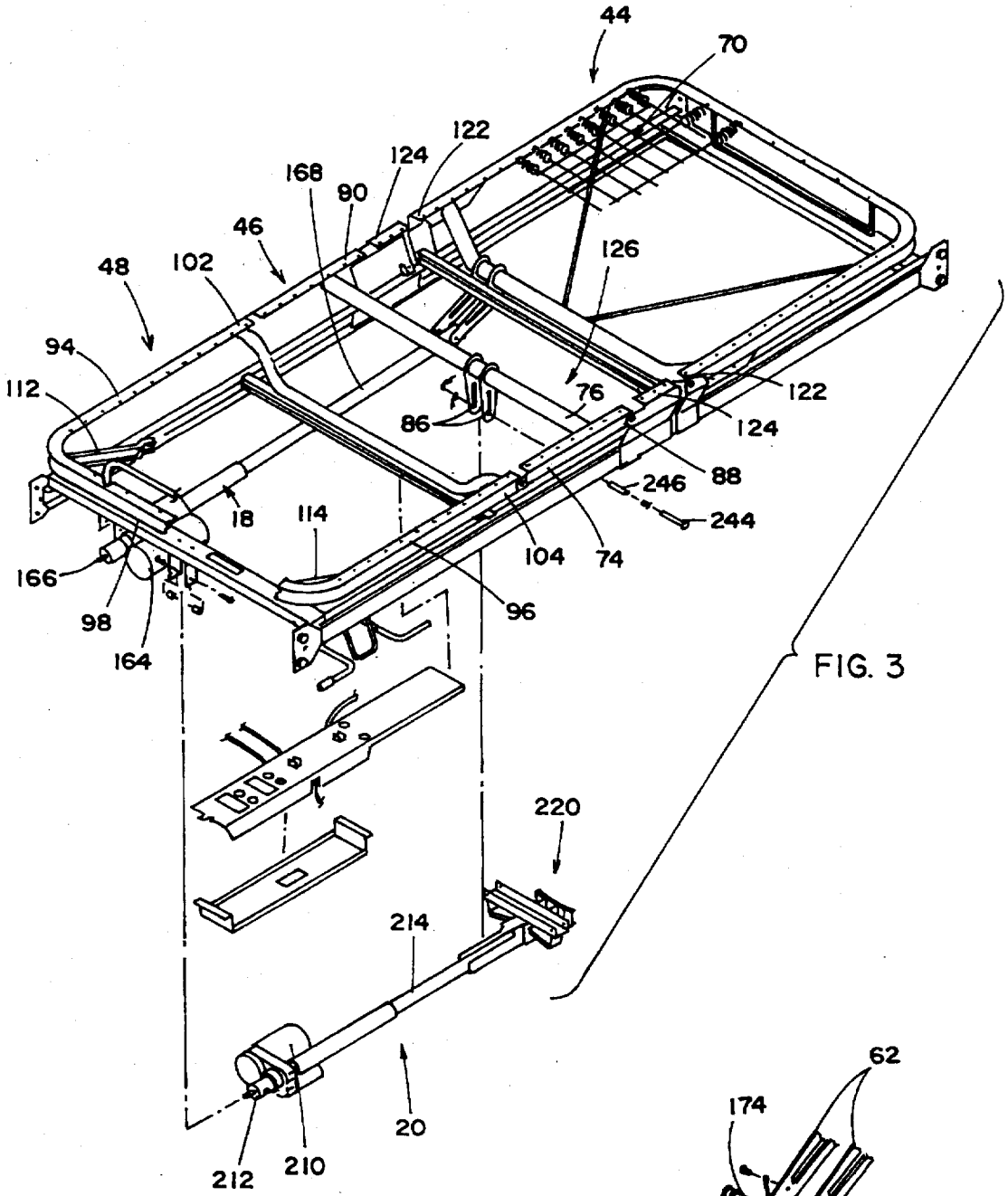
FIG. 3 is an exploded view of the main frame and mattress frame subassembly including the actuators.

Subassembly 12, as seen in FIGS. 1–3, includes a mattress frame 24 and a main or base frame 26. Base frame 26 includes side rails 28, 30, end rails 32, 34 and cross members 36, 38, 40. Mattress frame 24 includes a generally U-shaped head or back section 44, a knee section 46 and a leg section 48. Pivot brackets 52, 54 are mounted on side rails 28, 30 of main frame 26. Head section 44 is pivotally connected to brackets 52, 54 at ends 56, 58. Frame section 44 includes a configured cross member 60 to which a pair of crank arms 62 are nonrotatably affixed. Knee section 46 is attached to frame 26 at brackets 66, 68 which are also attached to the side rails of frame 26. A spring and wire mattress support 70 (FIG. 3) is attached to the frame sections.

Figure 5:
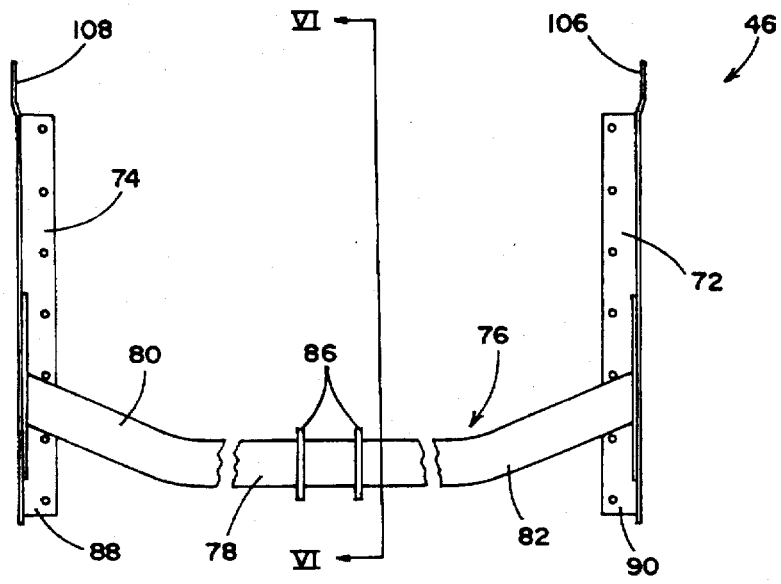
FIG. 5 is a plan view of a knee section of the mattress frame.
Figure 6:
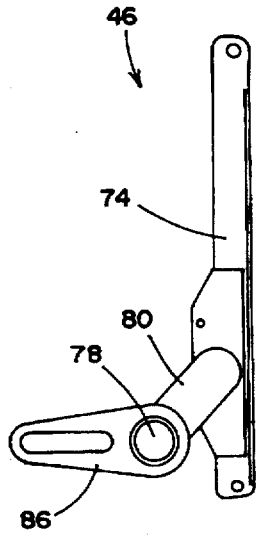
FIG. 6 is a cross-sectional view taken generally along line VI—VI of FIG. 5.

Knee section 46, as best seen in FIGS. 2, 3, 5 and 6, includes side rails 72, 74 and a configured crosspiece 76. Crosspiece 76 includes a center section 78 and end sections 80, 82 which are angled with respect to the center section. As seen in FIGS. 5 and 6, knee section crank arms 86 are welded or otherwise nonrotatably secured to center section 78 of crosspiece 76. Knee section 46 is pivoted to brackets 66, 68 at ends 88, 90.

Leg section 48 is generally U-shaped in plan and includes side portions 94, 96 and a base portion 98. Portions 94, 96 are pivoted at ends 102, 104 to ends 106, 108 of knee section 46. A pair of links 112, 114 (FIGS. 2 and 3) connect base portion 98 of leg section 48 to the main frame 26.

Mattress frame 24 is pivotally mounted on base frame 26. Section 44 may be articulated with respect to the remaining sections of the bed. Brackets 52, 54, 66 and 68, as seen in FIGS. 2 and 3, include in-turned flanges 122, 124. The brackets, therefore, form a seat section 126 for the mattress frame. Knee section 46 may be articulated with respect to the seat section. Clockwise rotation of section 46, as seen in FIG. 1, articulates section 46 with respect to section 48 so that the knee and leg sections assume the knee break position.

Figure 9:
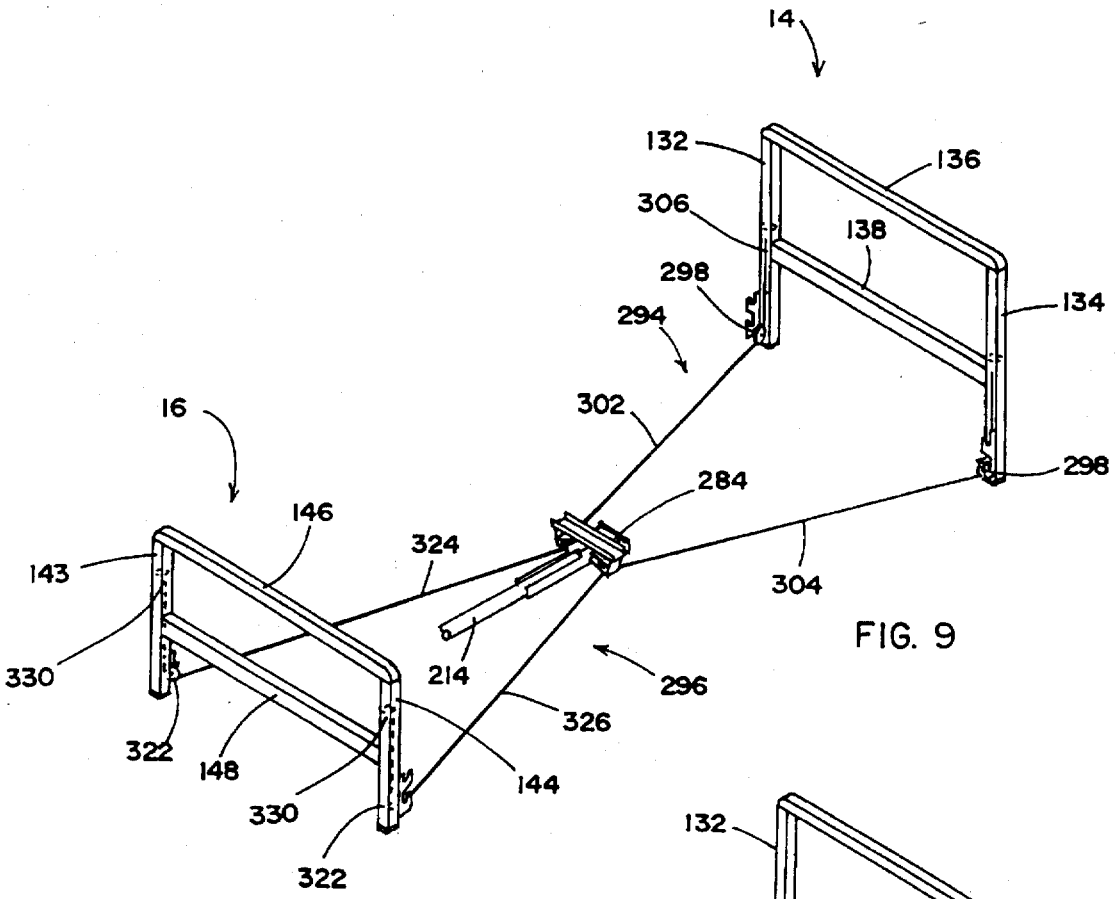
FIG. 9 is a fragmentary, perspective view showing portions of the high/low mechanism incorporated in the bed of the present invention.
Figure 10:
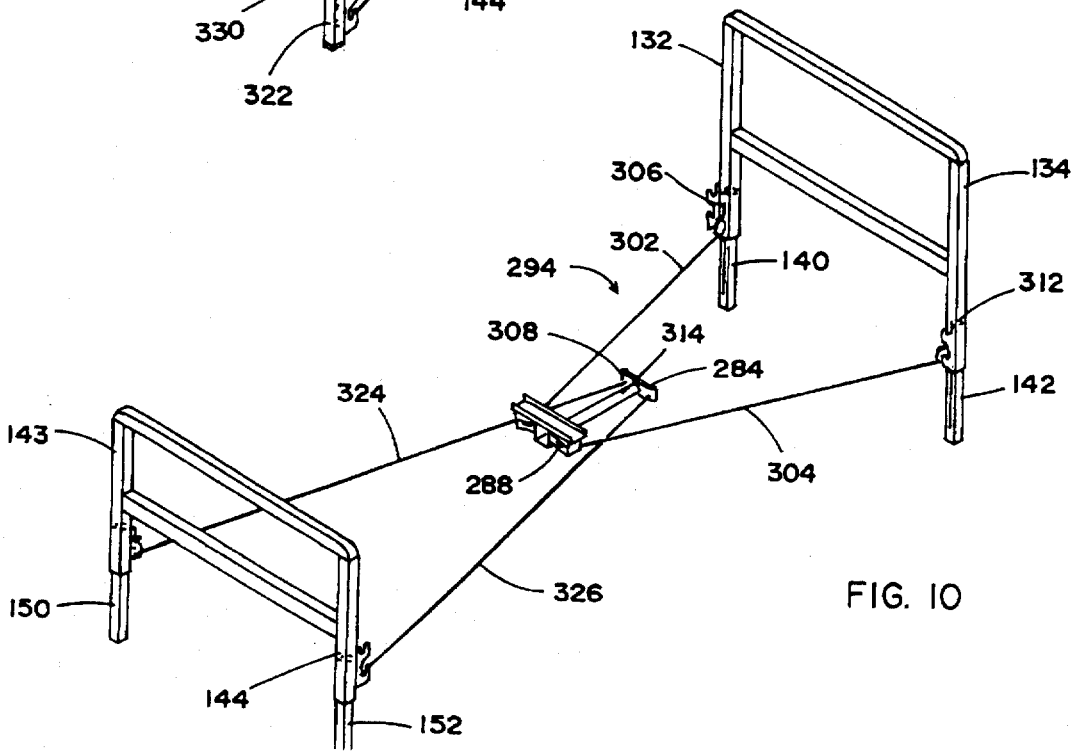
FIG. 10 is a perspective view of the high/low mechanism of FIG. 9 showing the mechanism in the high position.

As seen in FIGS. 1, 9 and 10, bed end assembly 14 includes vertical legs or posts 132, 134 and crosspieces 136, 138. Extendable, telescoping legs 140, 142 are positioned within posts 132, 134, respectively. Bed end assembly 16 similarly includes vertical posts 143, 144 and crosspieces 146, 148. Telescoping legs 150, 152 are positioned within sections 143, 144, respectively. Extension of the legs 140, 142, 150, 152 will raise the bed ends. Main frame 26 includes brackets 154 at each corner thereof. Frame 26 is fixed to vertical posts 132, 134, 143 and 144 of the bed ends. Raising these posts, therefore, raises the main frame and, hence, the mattress frame with respect to ground.

Figure 4:
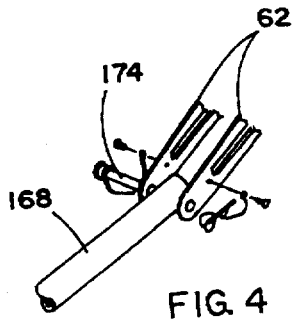
FIG. 4 is an enlarged, fragmentary view showing the connection between one actuator and a section of the mattress frame.

In accordance with the present invention, a first actuator subassembly 18 is provided for articulating mattress section 44 with respect to the remaining sections. Actuator subassembly 18 includes an electric motor drive 164 which rotates a lead screw subassembly 166. Rotation of the lead screw extends and retracts a drive tube or driven member 168. As seen in FIGS. 1 and 3, drive motor 164 is secured to end rail 34 of frame 26. Mounting brackets 172 are welded to the end rail 34 for such purpose. Drive tube 168 is pivotally secured to crank arms 62 by a pivot or clevis pin 174 as seen in FIG. 4. Movement of driven member 168 from a fully retracted position, as seen in FIGS. 1 and 3, to a fully extended position, as seen, for example, in FIG. 11, shifts crank arm 62 causing mattress frame section 44 to pivot about brackets 52, 54. Actuator 18, therefore, operates to raise and lower back or head section 44 to position the user in either a flat or seated position.

Second actuator subassembly 20 sequentially operates the high/low mechanism and articulation of the knee section 46 with respect to the seat and leg sections of the mattress frame. In the preferred form, actuator subassembly 20 includes an electric motor drive 210 which rotates a lead screw 212. Rotation of the lead screw extends and retracts a driven member or drive tube 214. A high/low knee or support subassembly 220 includes a channel-shaped mounting bracket 222. Mounting bracket 222 is secured by suitable fasteners to crosspiece 38 of base frame 26. A generally U-shaped housing or support 224 is welded or otherwise secured or formed with the undersurface of mounting bracket 222. In addition, pulley or sheave carriers 226, 228 are joined to support bracket 222 adjacent each side of housing 224. Drive tube 214 extends into housing 224.

Figure 7:
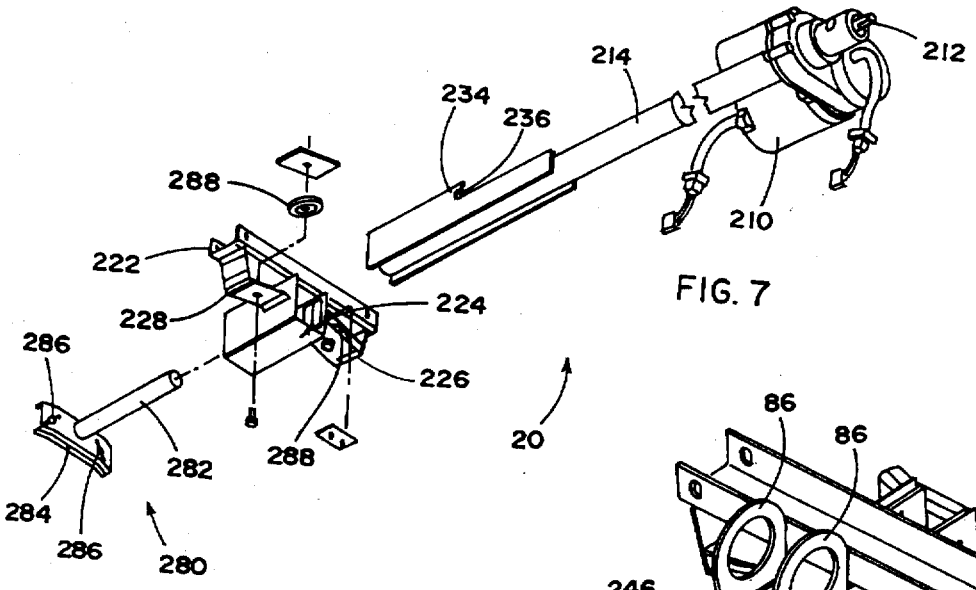
FIG. 7 is an exploded, perspective view of the knee break and high/low actuator in accordance with the present invention.
Figure 8:
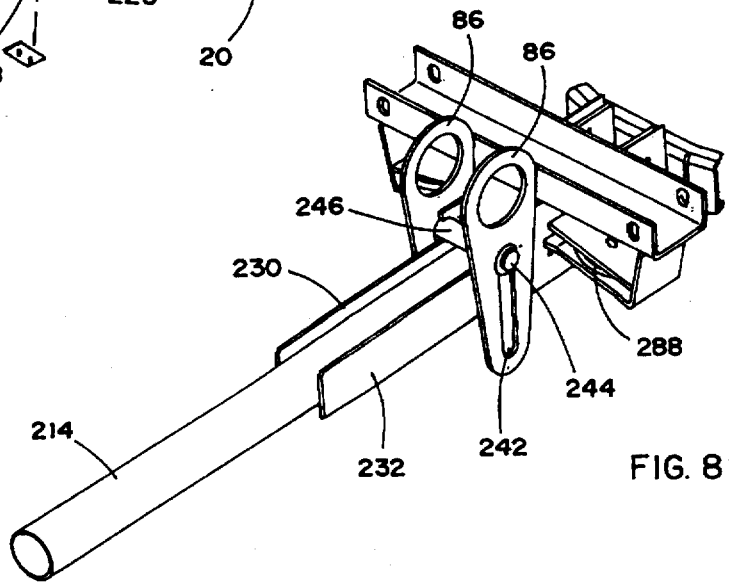
FIG. 8 is a perspective view of a high/low knee assembly incorporated in the actuator of FIG. 7.

As best seen in FIGS. 7 and 8, a pair of pull brackets 230, 232 are joined to sides of tube 214. The pull brackets extend into housing 224. Each pull bracket defines a generally hook-shaped pull portion 234 and, hence, a rearwardly opening slot 236.

Crank arms or level 86 are formed with elongated guide slots 242. A pin 244 extends between and rides within the slots. Pin 244 extends through and is received in a tubular spacer 246. As tube 214 is retracted from the position shown in FIGS. 3 and 8, pull brackets 230, 232 will engage pin 244 at slots 236. Further rearward or retracting movement rotates the crank arms 86 as the pins slide within the slots 242. Section 46 will pivot in a clockwise direction when viewed in FIG. 1 and articulate with respect to the seat and leg sections of the mattress frame.

Drive tube 214 also functions to operate the high/low mechanism of the bed. As seen in FIGS. 7 and 8, a cable carrier 280 includes an elongated guide tube or portion 282 and a cable attachment bracket 284. Tube 282 telescopes within the open end of drive tube 214. Bracket 284 defines slots 286. Sheaves or pulleys 288 are rotatably mounted on pulley carriers 226, 228. As best seen in FIGS. 9 and 10, cable carrier 280 is operatively connected to the telescoping legs of the bed ends through a cable assembly comprised of cable subassemblies 294, 296. Cable subassembly 294 includes pulleys 288, and further includes pulleys 298 which are rotatably mounted on posts 132, 134 of bed end 14. A pair of cables 302, 304 are provided. Cable 302 extends over pulley 298 and includes an end 306 fixed to an upper end of extendable leg 140. Cable 302 is reeved around or extends around sheave or pulley 288 on support subassembly 220 with its opposite end 308 attached to the cable carrier bracket 284 at one of the slots 286. Cable 304 similarly extends over pulley 298 where an end 312 attaches to the upper end of extendable leg 142. The cable then extends over the remaining pulley 288 with an end 314 connected to the cable carrier at the other slot 286.

Cable subassembly 296 similarly includes pulleys 322 secured to vertical posts 143, 144 of bed end 16. Cables 324, 326. extend from cable carrier bracket 284 to pulleys 322 and attach at ends 330 to the upper ends of extendable legs 150, 152. As should be apparent from FIGS. 7–10, extension of drive tube 214 moves it into contact with a rear face of cable carrier bracket 284. Drive tube 214 will shift or drive the cable carrier to the right when viewed in FIGS. 9 and 10. This action pulls on cables 302, 304, 324, 326, causing telescoping leg portions 140, 142, 150, 152 to extend from the bed ends, thereby raising the bed ends and the mattress and main frame with respect to the floor.

OPERATION

In view of the above description, the operation of the adjustable bed in accordance with the present invention should be readily apparent. Motors 164, 210 of the actuators are connected to a conventional six-button or four-button pendant control (not shown) which controls the direction of rotation of the motors and, hence, the articulation function performed. With a four-button pendant control, two buttons are used to move the head section 44. Pressing one button extends drive tube 168 of actuator 18 pivoting mattress section 44 in a counterclockwise direction, as seen in FIGS. 11 and 12. Pressing the other button of the pendant control operates the motor in reverse, retracting drive tube 168 causing section 44 to rotate in a clockwise direction when viewed in FIGS. 11 and 12. Operation of the head section positioning is independent of operation of the second actuator.

Pressing another of the buttons on the pendant activates motor 210 of actuator 20 causing drive tube 214 to extend. Extension of the drive tube shifts the cable carrier, pulling on the cable assemblies, raising the base frame 26 from a lowered position, shown in FIG. 12, to an extended position, shown in FIG. 11, through extension of the telescoping leg elements. Operation of the drive motor in the opposite or reverse direction by pressing the remaining button retracts drive tube 214, permitting the telescoping legs to retract into the vertical posts of the bed ends. The bed will lower under its own weight. When the actuator reaches the position shown in FIG. 8, mattress sections 46, 48 are in the flat position, as shown in FIG. 11. Further retraction of drive tube 214 rotates crank arms 86. Pull brackets 230, 232 on drive tube 214 engage pin 244 extending between the crank arms. The crank arms are rotated from the position shown in FIG. 11 to the position shown in FIG. 12, causing rotation of mattress section 46 in a clockwise direction. Sections 46 and 48 are moved to the knee break position under the action of drive tube 214. The positioning of the lowermost end of leg section 48 is controlled by links 112, 114, as shown in FIGS. 11 and 12.

In order to avoid confusion in the operation of the bed, a standard six-button pendant control would be used. With such a control, the button to raise the knees and section 46 and the button to lower the knees and section 46 are deactivated and will not run actuator subassembly 20. When the mattress frame is in the low position, the button to lower the bed is deactivated and will not run actuator subassembly 20. When the knees are raised, the button to raise the mattress frame from the low to the high position is active. Use of this button will lower the knees before the mattress frame will rise.

Full electric capability is provided using only two electric drives. Complicated clutch subassemblies are eliminated. The adjustable bed in accordance with the present invention is significantly less complex than prior hospital, institutional or home care beds heretofore provided. The advantages of full electric, full function actuators are provided at reduced cost from that heretofore achieved. Only two electric motors are needed in place of the three previously required to achieve full adjustment of head position, knee break position and high/low position. The advantages of full electric beds are made available to the institutional and home healthcare markets. Operational, installation and use difficulties heretofore experienced are also eliminated or significantly reduced.

In view of the above description, those of ordinary skill in the art may envision various modifications which would not depart from the inventive concepts disclosed herein. A link high/low mechanism, for example, could be substituted for the cable mechanism shown. The resulting bed would still provide sequential high/low adjustment and knee break positioning. Drives other than the electric motors could be provided to extend and retract drive tubes 168, 214. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. A high/low mechanism for a bed, said mechanism comprising:

a pair of bed end assemblies, each assembly including a telescoping leg;

a frame extending between said bed end assemblies;

a support subassembly mounted on said frame, said support subassembly including a housing;

an actuator including a drive motor and an extendable and retractable actuator tube, said tube extending through said housing;

a cable carrier engaged and moved by said tube as said tube extends; and a cable assembly connected to said cable carrier and said telescoping legs to extend said legs to raise the frame when the cable carrier is moved by said tube.

2. A high/low mechanism as defined by claim 1 wherein said cable assembly comprises:

a first pulley on said support assembly;

a second pulley on one of said bed end assemblies;

a third pulley on the other of said bed end assemblies;

a first cable extending around said first pulley from said cable carrier and around said second pulley to said one of said bed end assemblies; and a second cable extending from said cable carrier and around said third pulley to said other of said bed end assemblies.

3. A high/low mechanism as defined by claim 2 wherein said cable carrier includes an elongated guide tube which telescopes with said actuator tube.

4. A high/low mechanism as defined by claim 3 further comprising a pull bracket joined to said actuator tube, said pull bracket defining a slot.

5. A high/low mechanism for a bed, said mechanism comprising:

a pair of bed end assemblies, each assembly including a telescoping leg;

a frame extending between said bed end assemblies;

a support assembly mounted on said frame, said support assembly including a housing;

an actuator including a drive motor and an extendable and retractable actuator tube, said tube extending through said housing;

a cable carrier engaging and moved by said tube as said tube extends;

a cable assembly connected to said cable carrier and said telescoping legs to extend said legs to raise the frame when the cable carrier is moved by said tube, said cable assembly including a first pulley on said support assembly, a second pulley on one of said bed end assemblies, a third pulley on the other of said bed end assemblies, a first cable extending around said first pulley from said cable carrier and around said second pulley to said one of said bed end assemblies, and a second cable extending from said cable carrier and around said third pulley to said other of said bed end assemblies; and a pull bracket joined to said actuator tube, said pull bracket defining a slot.

6. A high/low mechanism for a bed, said mechanism comprising:

a pair of bed end assemblies, each assembly including a telescoping leg;

a frame extending between said bed end assemblies;

a support assembly mounted on said frame, said support assembly including a housing;

an actuator including a drive motor and an extendable and retractable actuator tube, said tube extending through said housing;

a cable carrier engaged and moved by said tube as said tube extends, said cable carrier including an elongated guide tube which telescopes with said actuator tube; and a cable assembly connected to said cable carrier and said telescoping legs to extend said legs to raise the frame when the cable carrier is moved by said tube.

7. A high/low mechanism as defined by claim 6 further comprising a pull bracket joined to said actuator tube, said pull bracket defining a slot.

* * * * *